US005781090A

United States Patent [19]

Goloff et al.

[11] Patent Number: 5,781,090

[45] Date of Patent: Jul. 14, 1998

[54] LATCHING ELECTROMAGNET

[75] Inventors: C. Nickolas Goloff, Secor; Rodney L. Rolffs, East Peoria, both of Ill.

[73] Assignee: Caterpillar Inc., Peoria, Ill.

[21] Appl. No.: 824,583

[22] Filed: Mar. 26, 1997

Related U.S. Application Data

[63] Continuation of Ser. No. 244,071, Apr. 20, 1994, abandoned, which is a continuation-in-part of Ser. No. 69,797, Jun. 1, 1993, abandoned.

[51] Int. Cl.[6] ..... H01F 7/08

[52] U.S. Cl. ..... 335/276; 335/227; 335/238; 335/281

[58] Field of Search ..... 335/132, 227, 335/255, 272, 276, 278, 281, 238; 74/528, 523, 543, 545, 557, 491, 625

[56] References Cited

U.S. PATENT DOCUMENTS

| | | | |
|---|---|---|---|
| 3,571,769 | 3/1971 | Pegram | 335/230 |
| 3,644,932 | 2/1972 | Wallace et al. | 346/77 |
| 3,861,643 | 1/1975 | Moffatt | 251/129 |
| 3,993,972 | 11/1976 | Barbrook | 335/220 |
| 4,346,319 | 8/1982 | Naganuma | 310/36 |
| 5,066,980 | 11/1991 | Schweizer | 335/255 |

FOREIGN PATENT DOCUMENTS

| | | |
|---|---|---|
| 0 085 535 | 8/1983 | European Pat. Off. . |
| 0 296 983 | 12/1988 | European Pat. Off. . |
| 1135704 | 12/1968 | United Kingdom . |

*Primary Examiner*—Michael L. Gellner
*Assistant Examiner*—Raymond Barrera
*Attorney, Agent, or Firm*—David M. Masterson; Mario J. Donato, Jr.

[57] ABSTRACT

A latching electromagnet is provided. The electromagnet (300) includes a core (305) having a pole face, a coil of windings (325), and an armature (330). Advantageously, the core has a geometry that locally increases the magnetic flux density to saturation levels.

8 Claims, 6 Drawing Sheets

LATCHING ELECTROMAGNET

This application is a continuation of application Ser. No. 08/244,071, filed Apr. 20, 1994, ABANDONED, which was a continuation-in-part of application Ser. No. 08/069,797, filed Jun. 1, 1993, ABANDONED.

TECHNICAL FIELD

This invention relates generally to a latching electromagnet and, more particularly, to a latching electromagnet that operates with a portion of the core in magnetic saturation.

BACKGROUND ART

Latching electromagnets are used in variety of applications. In one application, a control circuit may require that an electromagnet "latch" a moveable member to a detent position. Further, the control circuit may also require that the moveable member be "de-latched" from the detent position by a mechanical device that has a predetermined force. However if the "latching" force of the electromagnet varies, then the mechanical device may not have sufficient force to overcome the electromagnetic force. Consequently the moveable member remains latched to the detent position, possibly causing the control system to malfunction.

In another application, an electromagnet may be provided to latch a control lever of an electrohydraulic control at a detent position. The control lever is latched at the detent position until; either the electromagnet de-energizes, or an operator manually de-latches the control lever from the energized electromagnet. If the later occurs, the operator must apply a force to the control lever that overcomes the electromagnetic force.

Unfortunately, prior electromagnet designs do not produce a substantially constant electromagnetic force. For example, a prior electromagnet 100 is shown in FIG. 1. The electromagnet 100 includes a core 105, a coil 110 and an armature 115. Upon being energized, the coil 110 produces an electromagnetic force which "latches" the armature 115 to the core 105. Upon deenergization of the coil 110, a spring 120 biases the armature to a neutral position.

Shown in FIG. 2, is a Force vs. Current curve which illustrates the relationship between the electromagnetic force and the coil current (when the armature is latched to the core). During operation, the coil current fluctuates between a minimum and maximum value. The current fluctuation is caused by changes in coil temperature and voltage. Due to the "steepness" of the curve, the resulting electromagnetic force may vary between a force that is too small—allowing for inadvertent de-latching of the control lever; to a force that is too large—yielding a force too great for the operator to overcome.

Another undesirable feature of the prior electromagnet design pertains to a varying air gap length. For example as shown in FIG. 1, the armature 115 is designed to latch "flush" with the electromagnetic core. However the air gap length may vary, which in turn varies the electromagnetic force. For example manufacturing tolerances, misalignment of the core/armature, and foreign materials that accumulate on the electromagnet parts (such as dust and rust particles), all may significantly vary the length of air gap. Significant variations in the air gap combined with coil current fluctuations make for difficult electromagnetic force controllability.

The present invention is directed to overcoming one or more of the problems as set forth above.

DISCLOSURE OF THE INVENTION

In one aspect of the present invention, a latching electromagnet is provided. The electromagnet includes a core having a pole face, a coil of windings, and an armature. Advantageously, the core has a geometry that locally increases the magnetic flux density to saturation levels.

BRIEF DESCRIPTION OF THE DRAWINGS

For a better understanding of the present invention, reference may be made to the accompanying drawings in which.

BEST MODE FOR CARRYING OUT THE INVENTION

Figure 1:
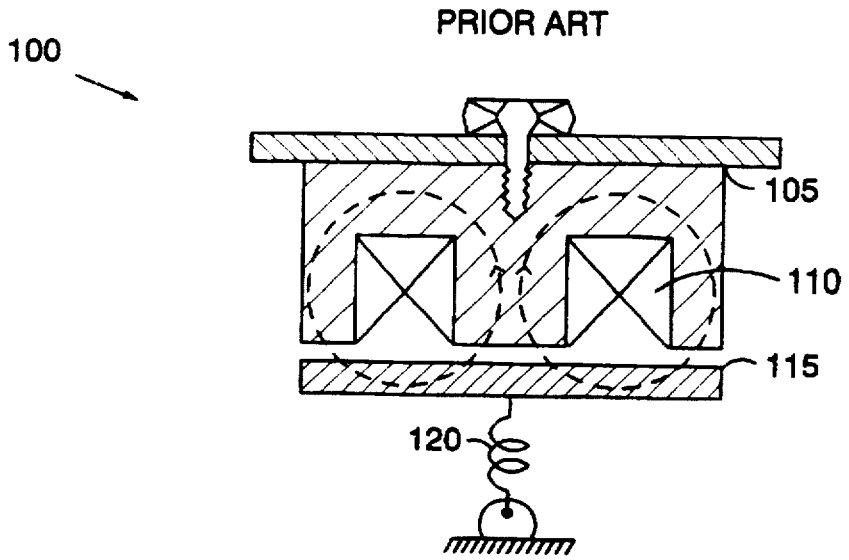
FIG. 1 shows a cross sectional view of a prior art electromagnet.
Figure 2:
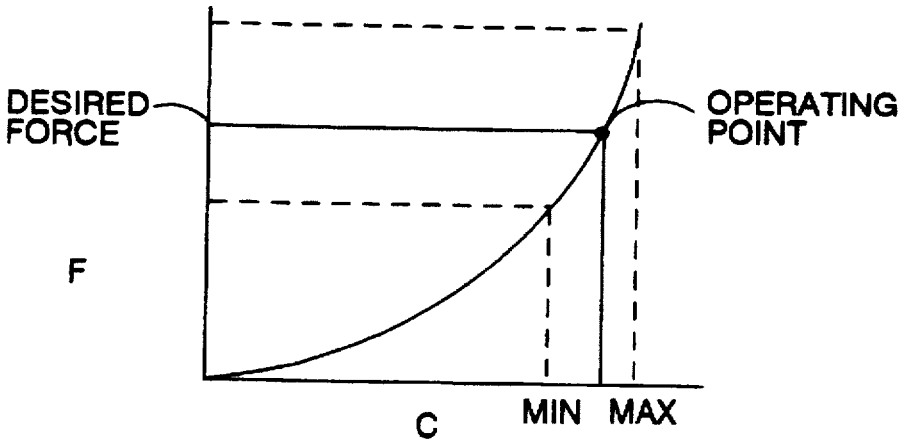
FIG. 2 shows a graph of the electromagnetic force vs. coil current associated with the prior art electromagnet.
Figure 3:
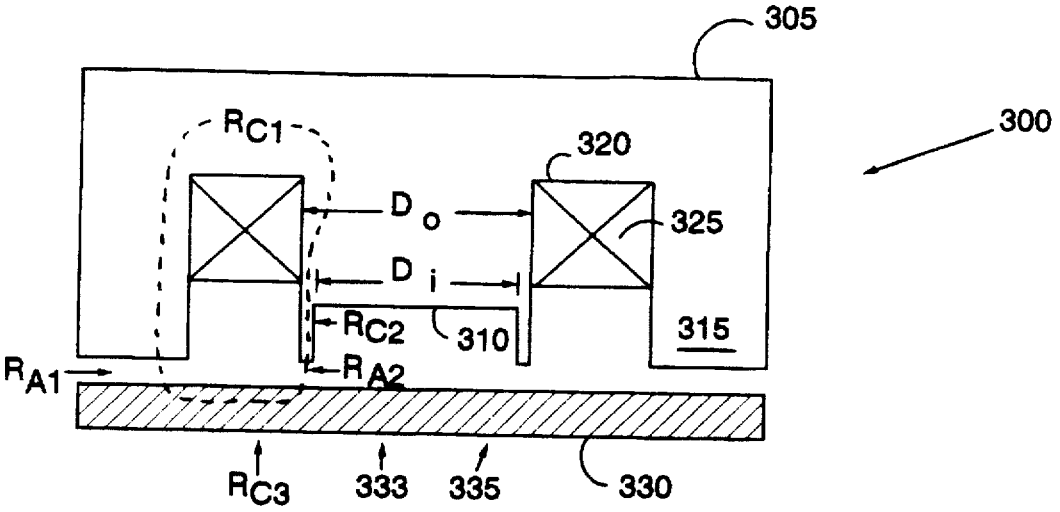
FIG. 3 shows a cross sectional view of an electromagnet associated with one embodiment of the present invention.

Referring now to FIG. 3 an embodiment of the present invention is shown. FIG. 3 illustrates a cross section of a cylindrical latching electromagnet 300. The electromagnet 300 includes a core 305 having a pole face, and inner and outer portions 310,315 that are separated by a channel 320. A coil 325 of windings is disposed in the channel 320. Upon energization of the coil 325, the coil 325 produces an electromagnetic force that causes an armature 330 to latch to the pole face.

Figure 4:
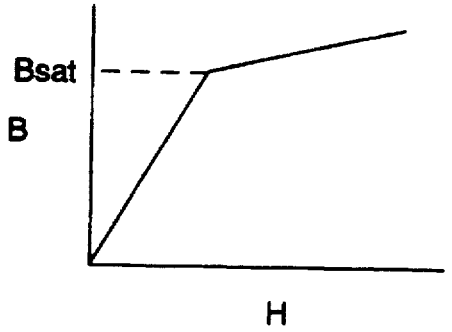
FIG. 4 shows a graph of the magnetic flux density vs. magnetic flux intensity of the electromagnet associated with the present invention.

To overcome the problems set forth in the background art section, supra, the electromagnet 300 is designed with a geometrical configuration formed at the core to locally increase the flux density to saturation levels. Shown in FIG. 4, is a typical B-H curve associated with the electromagnets of this type. The y-axis represents the magnetic flux density, B, while the x-axis represents the magnetic flux intensity or field strength, H. The portion of the curve that is above (Bsat) represents the saturated magnetic flux density region. The magnetic saturation region corresponds to a B-H relationship that naturally occurs in air.

One type of a geometrical configuration is shown in the embodiment of FIG. 3, where the core 305 defines a saturation region 335 on the inner portion 315 to provide for a saturated magnetic flux density. More particularly, the core 305 defines a bore 333 at the inner portion 315. The saturation region 335 has a predetermined cross sectional area, A, that is calculated in accordance with the following relationships:

$$Bsat = (\phi/A) = (Ni/RA) \quad [1]$$

solving for $A$ in eq. 1, $$A = (Ni/(R)\ (Bsat)) \quad [2]$$

$$A = \frac{Ni}{(R_{C1} + R_{C2} + R_{C3} + R_{A1} + R_{A2}) \times (Bsat)} = \frac{\pi}{4} \times (D_o^2 - D_i^2)$$

where, $\phi$=magnetic flux;

R=electromagnetic reluctance;

N=number of coil windings;

i=coil current;

$D_o$=outer diameter of the saturation region; and $D_i$=inner diameter of the saturation region.

The predetermined area of the saturation region 335 provides for little variation in magnetic flux density and electromagnetic force—even with changes in coil current and temperature.

Although one type of geometrical configuration is discussed above, it will be apparent to those skilled in the art that several other geometrical configurations may readily be implemented. Accordingly, the present invention is not limited to the geometrical configuration shown in FIG. 3 and described above.

Figure 5:
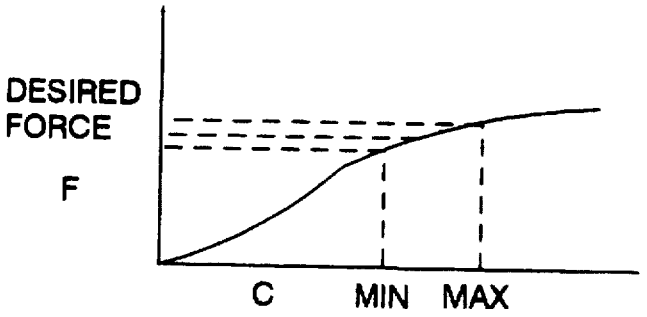
FIG. 5 shows a graph of the electromagnetic force vs. coil current of the electromagnet associated with the present invention.

The resulting Force vs. Current curve is described in FIG. 5. The desired electromagnetic force operates about a predetermined operating point. As shown, the part of the curve corresponding to the predetermined operating point is relatively "flat" as compared to the operating point associated with prior art electromagnets. Thus, coil current fluctuations produce only small changes in electromagnetic force, as compared to the prior art electromagnets.

Figure 6:
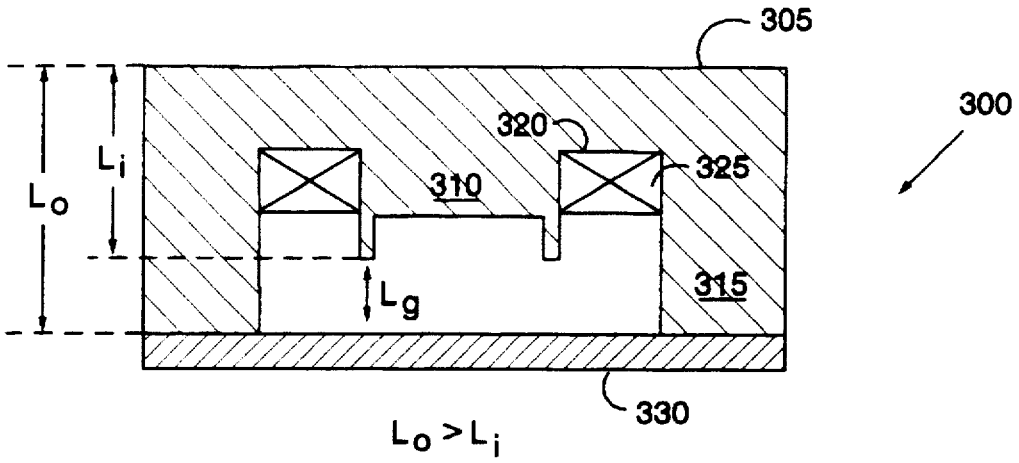
FIG. 6 shows a cross sectional view of an electromagnet associated with another embodiment of the present invention.

Another embodiment of the present invention is shown in FIG. 6. Here, the outer portion 315 is greater in length than the inner portion 310 to create a predetermined working air gap length, $L_g$, between the inner portion 310 and the armature 330 (when the armature 330 is latched to the pole face). Preferably, the predetermined air gap length, $L_g$, is substantially greater than the relative increase of the air gap length due to poor alignment, wear, foreign material, etc. Thus, the predetermined air gap length, $L_g$, provides for small changes in the electromagnetic force due to changes in the air gap length caused by armature/core misalignment.

Figure 7:
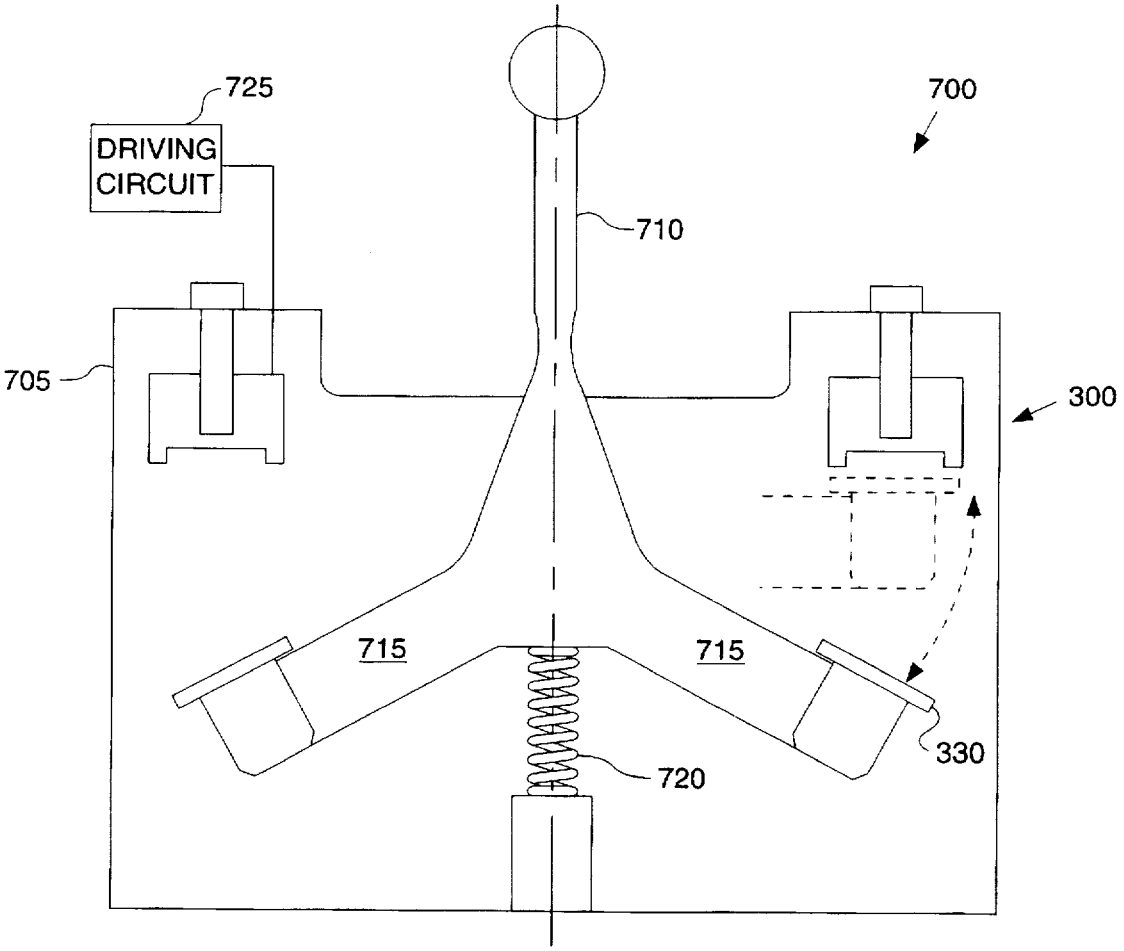
FIG. 7 shows a cross sectional view of an exemplary control mechanism associated with the present invention.

Although the present invention may be used in a variety of applications, one such application in FIG. 7. Here, the present invention is used to "latch" a control lever of a control mechanism at a detent position. As shown, the control mechanism 700 includes a housing 705 and a control lever 710 disposed in the housing 705. The control lever 710 has bi-directional, pivotal movement between a neutral and a predetermined position (on either side of neutral). As shown the control lever 710 defines two bifurcated arms 715. An electromagnet armature 330 is rigidly mounted to each lever arm 715. A centering spring 720 is attached to the bifurcation to bias the control lever 710 to the neutral position. The operation of the present invention in relation to the control mechanism 700 will be discussed infra.

Although the present invention is shown in relation to the control mechanism 700 of FIG. 7, it will be apparent to those skilled in the art that the present invention may be used in a variety of other applications that includes electronic, hydraulic, or pneumatic type devices.

Figure 8:
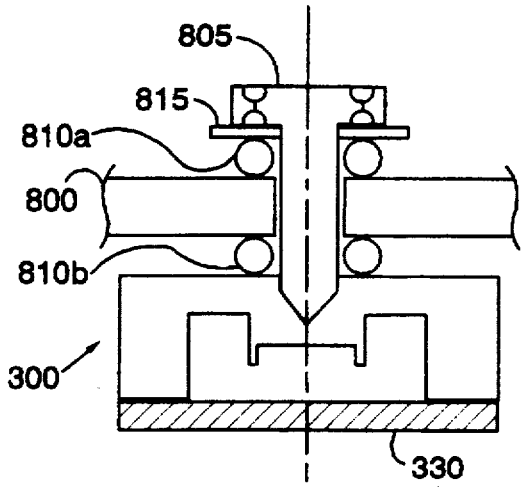
FIG. 8, 9, 10, and 11 show cross sectional views of securing mechanism for an electromagnet associated with the present invention.
Figure 9:
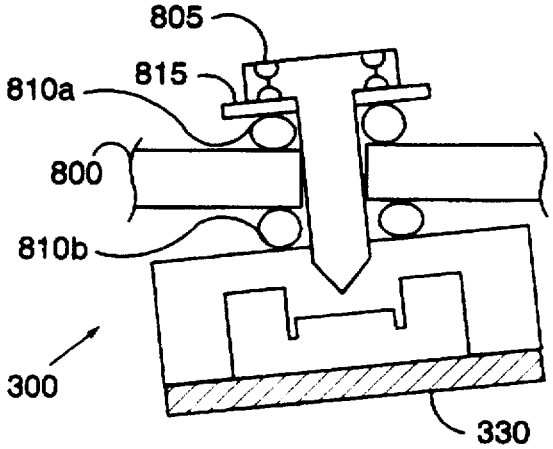

The present invention additionally provides for a self-aligning, mounting feature to compensate for the manufacturing tolerances or for poor alignment of the outer pole face with the armature. For example in FIG. 8, the electromagnet 300 is shown mounted to a mounting plate 800. A bolt 805 is used to fasten the electromagnet core 305 to the mounting plate 800. Two O-rings 810*a,b* composed of flexible material are also provided. One O-ring 810*a* is disposed between a washer 815 and the mounting plate 800, while the other O-ring 810*b* is disposed between the mounting plate 800 and the electromagnet core 305. The illustrated configuration provides a certain degree of flexibility to the mounting of the electromagnet. For example as shown in FIG. 9, the alignment of the armature 330 is "skewed" in relation to the x-axis and would not "mate" properly with a rigidly mounted electromagnet core. Here, however, the mounting is flexible which allows for the armature 330 to properly mate with the electromagnet core 305 irrespective of the armature orientation.

Figure 10:
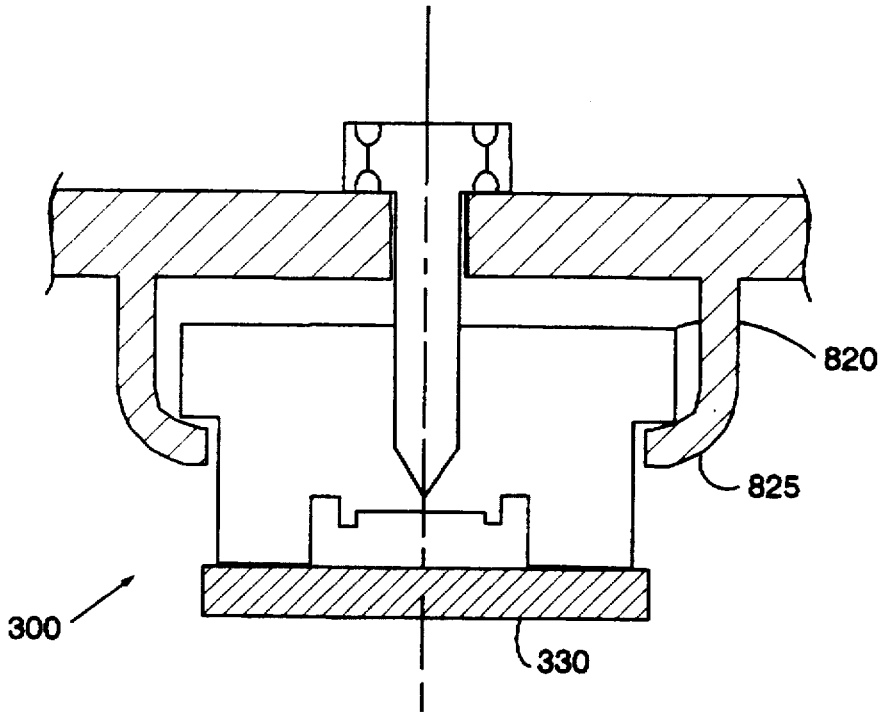
Figure 11:
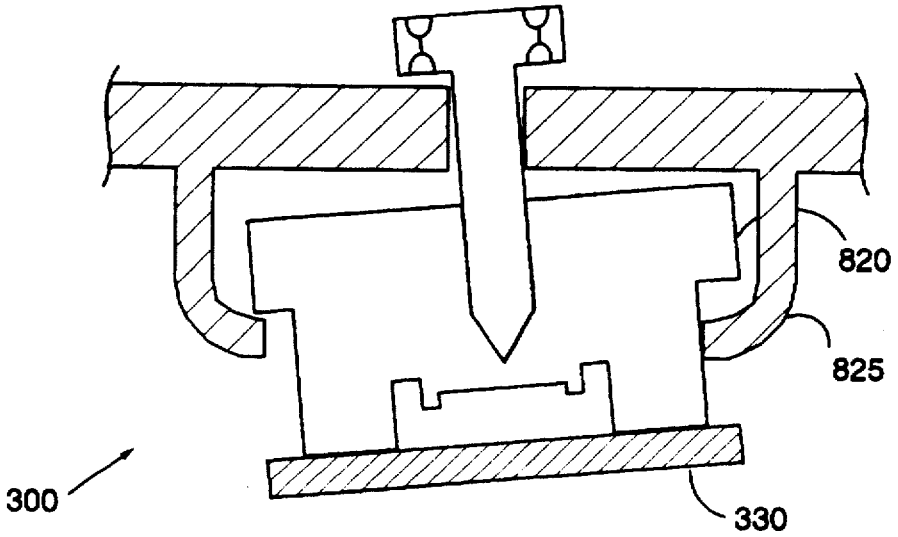

Another type of a self aligning feature is shown in FIG. 10. Here the electromagnetic core 330 includes a flange 820, and the mounting plate 800 includes a mechanical joint 825 for griping the flange 820 to secure the electromagnetic core 330 to the mounting plate 800. Similarly this feature also provides for mounting flexibility. For example as shown in FIG. 11, the misaligned armature 330 is properly mated with the electromagnet core 305.

Figure 12:
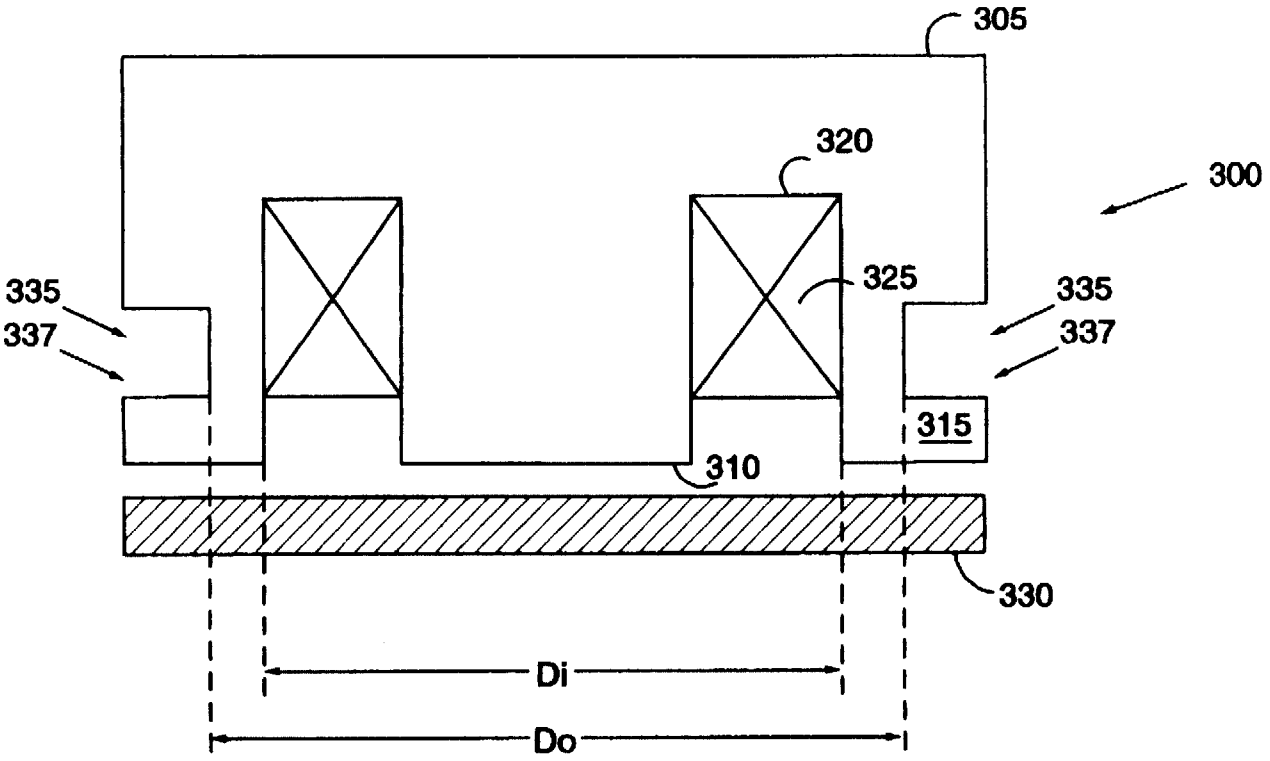
FIG. 12 shows a cross sectional view of an electromagnet associated with yet another embodiment of the present invention.

Another type of geometrical configuration is shown in the embodiment of FIG. 12. Here, the core 305 defines a saturation region 335 on the outer portion 315 to provide for a saturated magnetic flux density. More particularly, the core 305 defines an annular groove 337 on the outer core surface. The saturation region 335 has a cross sectional area, A, with the following relationship:

$$A = \frac{\pi}{4} \times (D_o^2 - D_i^2)$$

where $D_o$ represents the outer diameter of the saturation region and $D_i$ represents the inner diameter of the saturation region.

This geometrical configuration provides for several advantages. Because the pole faces are not modified to create the saturation region, the surface areas of the pole faces may be relatively large to yield a relatively high latching force. Moreover, this configuration produces negligible variations in magnetic flux density and electromagnetic force.

Industrial Applicability

The operation of the present invention may be used in an implement control system of a work vehicle. Although an implement control system is described, it will be apparent to those skilled in the art that the present invention may be used in a variety of applications where "latching" is desired.

The present invention may provide for "automatic" control of a work implement of the vehicle. For example, the electromagnet 330 "latches" the control lever 710 at a predetermined lever position, which represents a predetermined position of the work implement, e.g. a predetermined bucket "lift" or "angle".

In operation, the vehicle operator pivots the control lever 710 to a predetermined position. A driving circuit 725 delivers an energization signal to the electromagnet 300 which responsively energizes and "latches" the control lever 705 at the predetermined lever position. Accordingly, an electrohydraulic system positions the work implement to a predetermined position. Once the work implement reaches the predetermined position, the implement control system may then de-energize the electromagnet 300 to cause the control lever 710 to de-latch from the electromagnet 300. The spring 720 then biases the control lever 710 to the neutral position.

It may, however, be desirable for the vehicle operator to "manually" de-latch the control level 710 from the predetermined position.

Advantageously, the present invention provides for a predetermined electromagnetic force that is large enough to overcome the spring force of the spring 720 but small enough to be overcome by the force applied by the vehicle operator. Further, the present invention provides that the predetermined electromagnetic force to remain substantially constant (even when driven with a fluctuating coil current).

Thus, the electromagnetic force remains within a predetermined force range to provide a substantially constant force level that prevents inadvertent de-latching caused by the electromagnetic force falling below the spring force, and also prevents the electromagnetic force from becoming too large to be manually exceeded by an operator. This feature enables the electromagnet to be used in a variety of control systems wherein a constant electromagnetic force is desired.

Other aspects, objects and advantages of the present invention can be obtained from a study of the drawings, the disclosure and the appended claims.

We claim:

1. A control mechanism, comprising:

a housing;

a lever being disposed in the housing and having pivotal movement between a neutral and a predetermined position, the lever defining an arm;

a latching electromagnet being secured to the housing and including:

an outer portion of the core defining a pole face;

a coil of windings disposed in the core;

an armature being rigidly attached to the arm;

wherein the core defines a saturation region to provide for a saturated magnetic flux density, the saturation region having a cross sectional area, A, with the following relationship:

$$A = \frac{\pi}{4} \times (D_o^2 - D_i^2)$$

where $D_o$ represents the outer diameter of the saturation region and $D_i$ represents the inner diameter of the saturation region; and means for supplying electrical energy to the coil in response to the lever being positioned at a predetermined position, the coil responsively energizing and producing an electromagnetic force that causes the lever to latch at the predetermined position;

wherein the core has a circular shape and defines an inner and outer portion that is separated by an annular channel, the core further defining an annular groove that is located on the outer surface of the core to provide a saturated magnetic flux density, the saturation region being disposed between the annular groove and annular channel.

2. A control mechanism, as set forth in claim 1, including a self-aligning mounting system for the electromagnet.

3. A control mechanism (700), as set forth in claim 1, wherein the energized coil (325) produces a substantially constant electromagnetic force.

4. A control mechanism (700), as set forth in claim 3, including a centering spring (720) connected to the lever arm (715), the centering spring (720) biasing the lever (715) to the neutral position in response to the coil (325) being deenergized.

5. A control mechanism, comprising:

a housing;

a lever being disposed in the housing and having pivotal movement between a neutral and a predetermined position, the lever defining an arm, said lever extending through a wall of said housing;

a latching electromagnet being secured to the housing and including:

an outer portion of the core defining a pole face;

a coil of windings disposed in the core;

an armature being rigidly attached to the arm;

wherein the core defines a saturation region to provide for a saturated magnetic flux density, the saturation region having a cross sectional area, A, with the following relationship:

$$A = \frac{\Pi}{4} \times (Do^2 - Di^2)$$

where $D_o$ represents the outer diameter of the saturation region and $D_i$ represents the inner diameter of the saturation region; and means for supplying electrical energy to the coil in response to the lever being positioned at a predetermined position, the coil responsively energizing and producing an electromagnetic force that causes the lever to latch at the predetermined position;

wherein the core has a circular shape and defines an inner and outer portion that is separated by an annular channel, the core further defining an annular groove that is located on the outer surface of the core to provide a saturated magnetic flux density, the saturation region being disposed between the annular groove and annular channel.

6. A control mechanism, as set forth in claim 5, wherein the energized coil produces a substantially constant electromagnetic force.

7. A control mechanism, as set forth in claim 5, including a centering spring connected to the lever arm, the centering spring biasing the lever to the neutral position in response to the coil being deenergized.

8. A control mechanism, as set forth in claim 5, including a self-aligning mounting system for the electromagnet.

* * * * *